US006113203A

United States Patent [19]

Chen

[11] Patent Number: 6,113,203

[45] Date of Patent: Sep. 5, 2000

[54] TOOL BOX ASSEMBLY

[76] Inventor: Kuen Jen Chen, No. 6, Lane 609, Sec. 1, Chong San Road, Da Chia Town, Taichung Hsien 437, Taiwan

[21] Appl. No.: 09/346,383

[22] Filed: Jul. 1, 1999

[51] Int. Cl.[7] ..... A47B 47/00

[52] U.S. Cl. ..... 312/258; 312/263

[58] Field of Search ..... 312/257.1, 263, 312/265.5, 258

[56] References Cited

U.S. PATENT DOCUMENTS

| | | | |
|---|---|---|---|
| 3,779,623 | 12/1973 | Motohashi | 312/257.1 X |
| 4,782,972 | 11/1988 | Wenkman et al. | 312/257.1 X |
| 4,836,626 | 6/1989 | Taylor et al. | 312/263 X |
| 5,048,902 | 9/1991 | Daly | 312/257.1 X |
| 5,249,857 | 10/1993 | Suzuki | 312/263 |
| 5,368,380 | 11/1994 | Mottmiller et al. | 312/263 |
| 5,372,415 | 12/1994 | Tisbo et al. | 312/263 X |
| 5,902,025 | 5/1999 | Yu | 312/265.5 X |
| 5,975,660 | 11/1999 | Tisbo et al. | 312/263 |

FOREIGN PATENT DOCUMENTS

| | | | |
|---|---|---|---|
| WO9101098 | 2/1991 | WIPO | 312/265.5 X |

*Primary Examiner*—Peter R. Brown
*Assistant Examiner*—Michael J. Fisher
*Attorney, Agent, or Firm*—Charles E. Baxley, Esq.

[57] ABSTRACT

A tool box includes a rear panel and two side panels pivotally coupled together. A door frame is secured to the front portions of the side panels and a door panel pivotally coupled to the door frame. An upper panel and a lower panel have a number of peripheral projections engaged into and secured to the side panels and the rear panel and the door frame. A top panel and a base panel are further secured on top and on the bottom of the side panels and the rear panel and the door frame for solidly securing the panels and the door frame together without fasteners.

9 Claims, 4 Drawing Sheets

TOOL BOX ASSEMBLY

BACKGROUND OF THE INVENTION

1. Field of the Invention

The present invention relates to a tool box, and more particularly to a tool box that may be assembled without fasteners.

2. Description of the Prior Art

Typical tool boxes comprise a number of panels and partitions manufactured separately and required to be assembled together before use. A number of fasteners are required to secure and to assemble the panels and the partitions together. However, it takes a lot of time to assemble the panels and the partitions by threading the fasteners.

The present invention has arisen to mitigate and/or obviate the afore-described disadvantages of the conventional tool boxes.

SUMMARY OF THE INVENTION

The primary objective of the present invention is to provide a tool box including a number of panels that may be secured and assembled together easily and fast without fasteners.

In accordance with one aspect of the invention, there is provided a tool box comprising a rear panel including one or more cavities and an engaging member provided in the upper and the lower portions, two side panels pivotally coupled to the rear panel and each including one or more cavities and an engaging member provided in the upper and the lower portions, a door frame including one or more cavities and an engaging member provided in the upper and the lower portions, a door panel pivotally secured to the door frame, an upper panel and a lower panel each including a number of peripheral projections engaged into the cavities of the side panels and the rear panel and the door frame for securing to the panels and the door frame, a top panel and a base panel each including a number of peripheral engaging members engaged with the engaging members of the panels and the door frame for solidly securing the top panel and the base panel to the other panels and the door frame. The side portions of the door frame each includes a groove for receiving the flanges of the side panels and for securing the side panels and the door frame together.

The engaging members of the panels and the door frame are beams or ribs engaged with each other for securing the panels together. The top panel and the base panel each includes a peripheral wall for supporting the ribs.

The side panels and the rear panel and the door frame each includes at least one rib extended inward of the cavities, the projections of the upper and the lower panels each includes a plurality of ribs engaged with the ribs of the side panels and the rear panel and the door frame for further solidly securing the upper and the lower panels to the side and the rear panels and the door frame.

The side panels and the rear panel each includes one or more channels, the tool box includes at least one plate having a peripheral portion engaged in the channels for securing the plate between the panels.

The side panels and the rear panel each includes one or more ribs extended inward of the channels, the plate includes a number of peripheral ribs engaged with the ribs of the side panels and the rear panel for further solidly securing the plate to the side panels and the rear panel. The plate includes one or more bottom depressions for reducing the weight thereof. The base panel includes a number of wheels for allowing the tool box to be easily moved.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
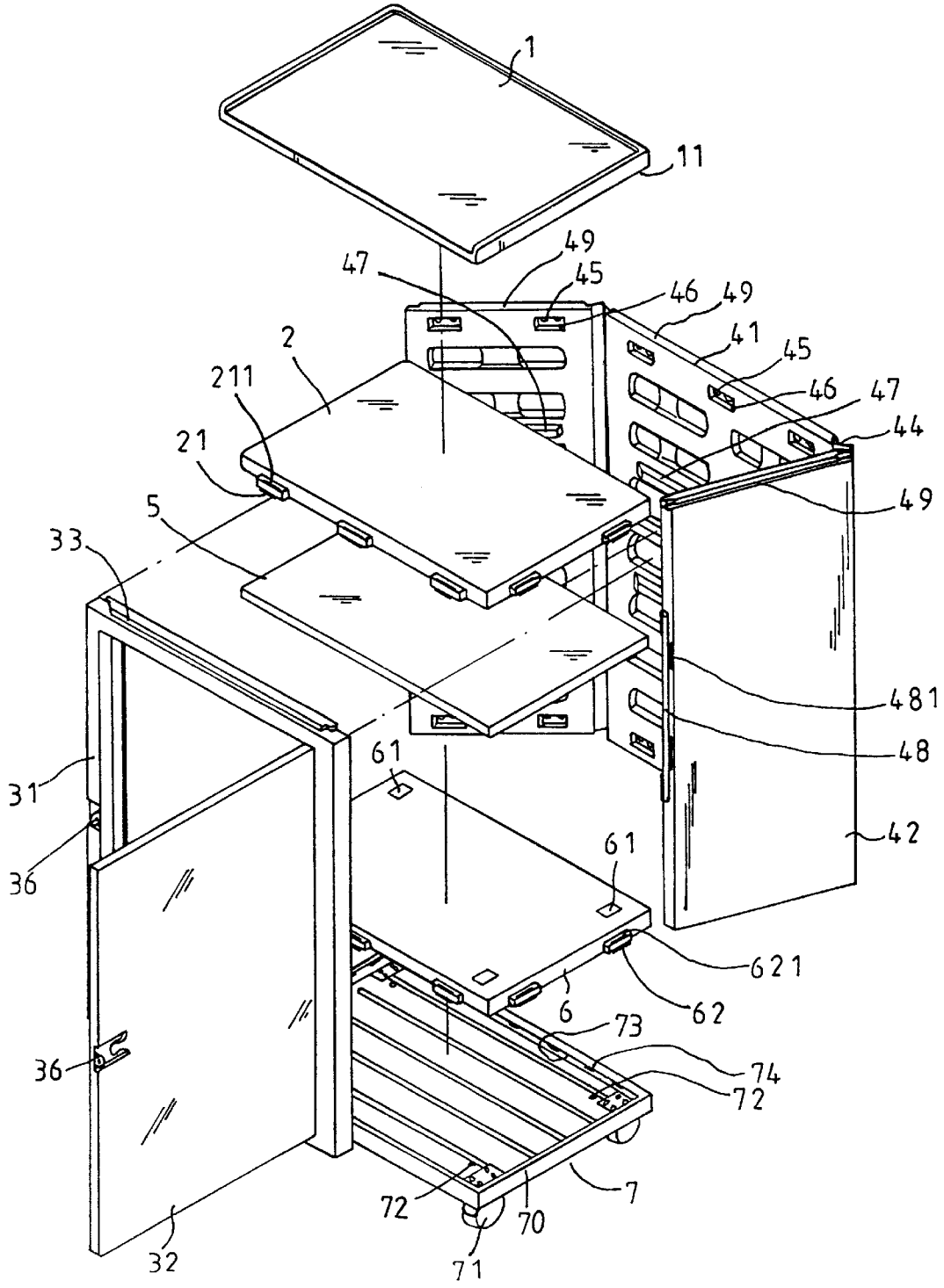
FIG. 1 is an exploded view of a tool box.
Figure 2:
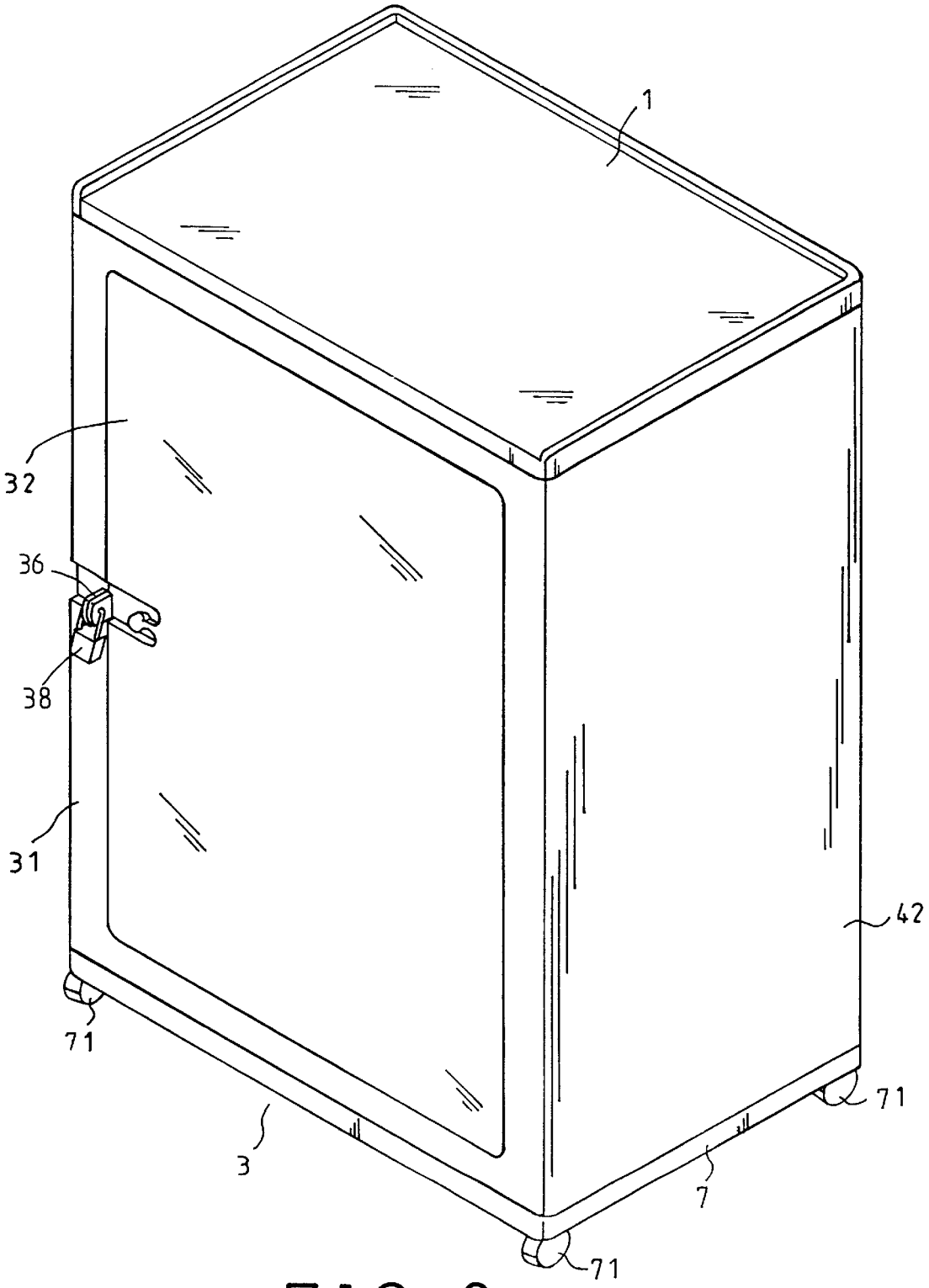
FIG. 2 is a perspective view of the tool box.

Referring to the drawings, and initially to FIGS. 1 and 2, a tool box in accordance with the present invention comprises a rear panel 41 and two side panels 42 each pivotally coupled to the side portions of the rear panel 41 at a live hinge 44. The side panels 42 and the rear panel 41 each includes an engaging member 49, such as a slot or a beam, formed on top thereof or extended laterally therefrom and another engaging member 49, such as a slot or a beam, formed on the bottom portion thereof. The upper portions and the lower portions of the side panels 42 and the rear panel 41 each includes one or more cavities 45 formed therein and facing inward of the tool box to be made and each includes one or more ribs 46 extended inward of the cavities 45. It is preferable that one rib 46 extended inward of the upper and outer portion of each of the cavities 45 and the other rib 46 extended inward of the lower and outer portion of each of the cavities 45 of the panels 41, 42. The side panels 42 and the rear panel 41 each includes a channel 47 formed in the middle portion thereof and one or more ribs extended inward of the channel 47 similar to the ribs 46. The side panels 42 each includes a flange 48 extended forward therefrom and each includes one or more ribs 481 extended laterally from each of the ribs 481.

Figure 4:
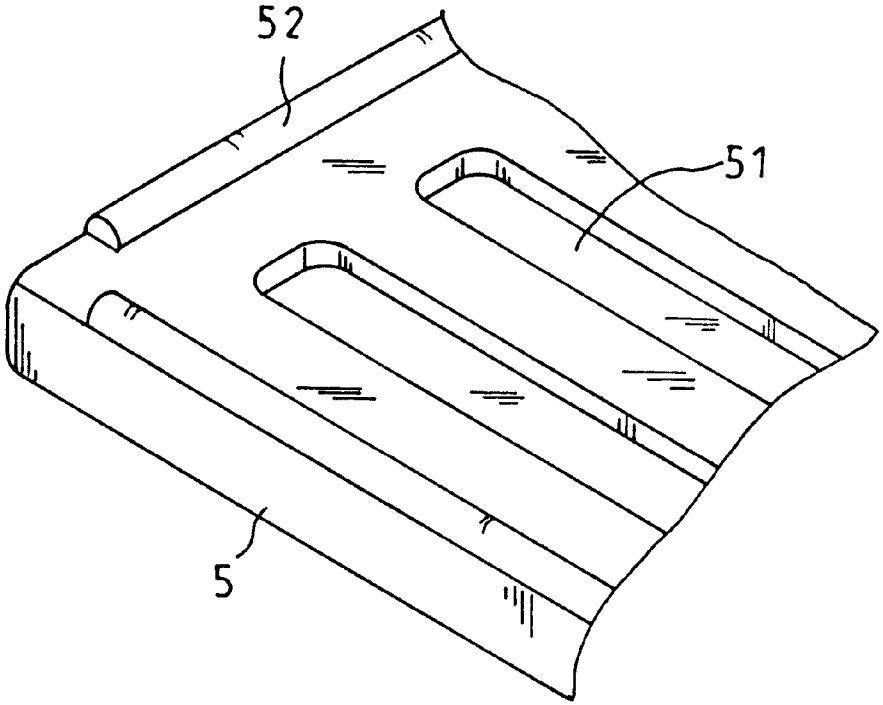
FIG. 4 is a partial bottom perspective view of a partition.
Figure 5:
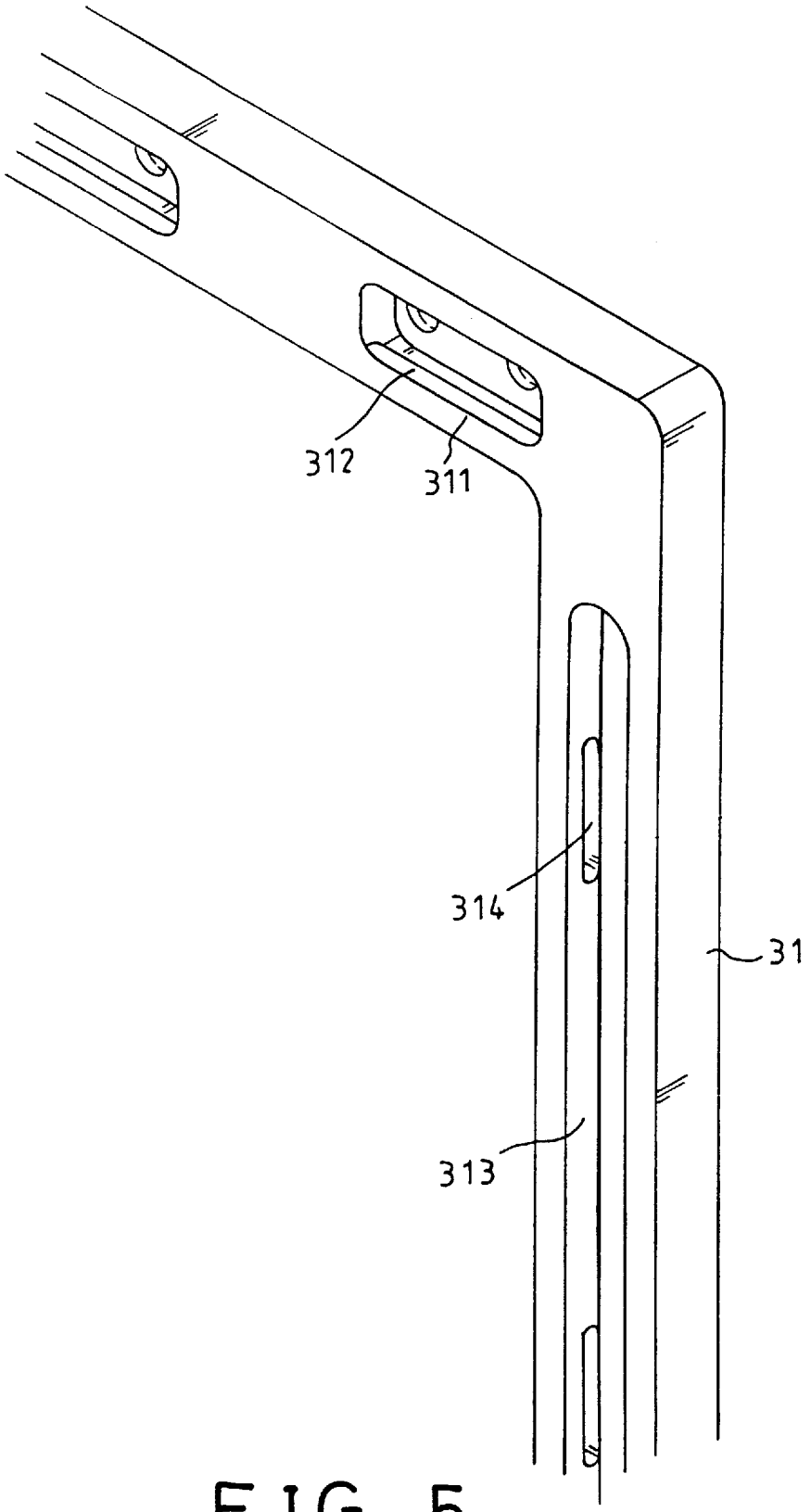
FIG. 5 is a partial rear perspective view of a door frame.

One or more plates 5 are optionally provided and have the peripheral portions engaged in the channels 47 of the side panels 42 and the rear panel 41 for securing the plates 5 within the tool box and for supporting objects or tools thereon. The plates 5 each includes one or more depressions 51 (FIG. 4) formed in the bottom for reducing the weight thereof and each includes a number of ribs 52 (FIG. 4) extended from the peripheral portion thereof for engaging with the ribs that extended inward of the channels 47 of the panels 41, 42 and for further securing the plates 5 to the panels 41, 42. The tool box comprises a front portion 3 including a door frame 31 is disposed in front of the side panels 42 and including an upper portion and a lower portion each having one or more cavities 311 formed therein (FIG. 5) and facing rearward toward the side panels 42 and each including one or more ribs 312 extended inward of the cavities 311. The upper portion and the lower portion of the door frame 31 each includes an engaging member 33, such as a slot or a beam, formed thereon. As also shown in FIG. 5, the door frame 31 includes two side portions each having a longitudinal groove 313 formed therein for receiving the flange 48 of the side panel 42 and each having one or more ribs or slots 314 formed therein and communicating with the groove 313 for receiving the ribs 481 of the flange 48 of the side panel 42 and for securing the door frame 31 to the side panels 42. A door panel 32 is pivotally coupled to the door frame 31 for forming the door of the tool box to be made. The door frame 31 and the door panel 32 each includes a lock ring 36 formed thereon for engaging with a lock 38 and for locking the door panel 32 in place.

Figure 3:
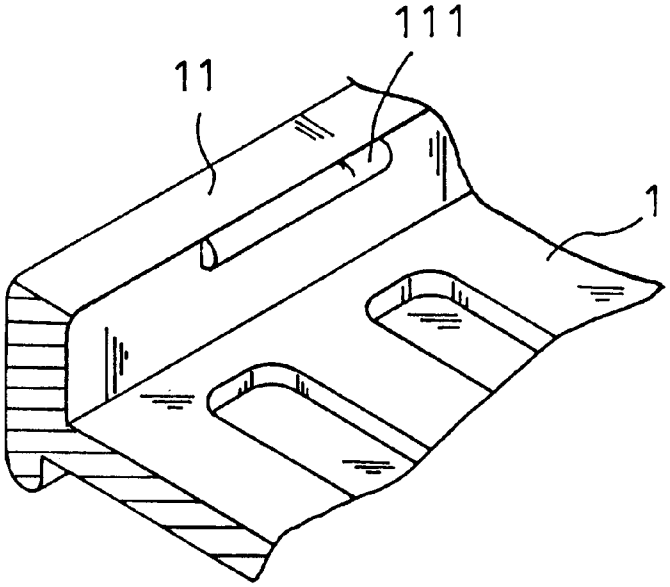
FIG. 3 is a partial bottom perspective view of a top panel.

An upper panel 2 and a lower panel 6 each includes a number of projections 21, 62 extended laterally outward therefrom for engaging into the cavities 45, 311 of the rear panel 41, the side panels 42 and the door frame 31, and each includes a number of ribs 211, 621 for engaging with the ribs 46, 312 of the rear panel 41, the side panels 42 and the door frame 31 and for solidly securing the upper panel 2 and the lower panel 6 in place between the rear panel 41, the side panels 42 and the door frame 31. A top panel 1 includes a peripheral wall 11 extended downward from the peripheral portion thereof and includes a number of ribs 111 (FIG. 3) extended inward from the peripheral wall 11 thereof and engaged with the slots or beams 49, 33 of the rear panel 41, the side panels 42 and the door frame 31 for solidly securing the top panel 1 to the upper portions of the rear panel 41, the side panels 42 and the door frame 31. A base panel 7 includes a peripheral wall 70 extended upward from the peripheral portion thereof and includes a front portion and a rear portion and two side portions each having an engaging member 73 provided therein, such as the slots 73 and/or the beams 74, for engaging with the slots or beams 49, 33 of the rear panel 41, the side panels 42 and the door frame 31 for solidly securing the base panel 7 to the bottom portions of the rear panel 41, the side panels 42 and the door frame 31.

It is to be noted that the above-described rear panel 41, side panels 42, door frame 31, upper panel 2, lower panel 6, top panel 1 and base panel 7 may be solidly secured together with the engagement of the ribs-and-ribs, and/or with the engagement of the ribs-and-slot, and/or with the engagement of the ribs-and-projections, and/or with the engagement of the projections-and-slots, for forming the tool box without any further fasteners. The projections 62 of the upper and the lower panels 2, 6 should first be engaged into the cavities 45, 311 of the panels 41, 42 and the door frame 31 before the top panel 1 and the base panel 7 are secured to the panels 41, 42 and the door frame 31.

The base panel 7 includes a number of wheels 71 secured to the bottom thereof for allowing the tool box to be easily moved. The lower panel 6 includes one or more orifices 61 formed therein. The base panel 7 includes a number of screw holes 72 formed therein and aligned with the orifices 61 of the lower panel 6. One or more fasteners may further be provided and engaged through the orifices 61 of the lower panel 6 and engaged with the lower panel 6 and threaded to the screw holes 72 of the base panel 7 for further solidly securing the lower panel 6 and the base panel 7 together. When the lower panel 6 and the base panel 7 are further solidly secured together, the rear panel 41, the side panels 42 and the door frame 31 may also be further solidly secured in place by the engagement of the projections 62 and ribs 621 of the lower panel 6 with the cavities 45, 311 and ribs 46, 312 of the side panels 42 and the rear panel 41 and the door frame 31 and with the engagement of the slots or beams 49, 33 of the rear panel 41, the side panels 42 and the door frame 31 and the slots 73 and/or beams 74 of the base panel 7. The securing between the lower panel 6 and the base panel 7 by the fasteners is optional and may secure the elements of the tool box in place.

Accordingly, the tool box includes a number of panels that may be secured and assembled together easily and fast without fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising:

a rear panel including an upper portion and a lower portion each having at least one cavity formed therein, and including two side portions, said upper portion and said lower portion of said rear panel each including an engaging member provided therein, two side panels pivotally coupled to said side portions of said rear panel respectively and each including an upper portion and a lower portion each having at least one cavity formed therein, and each including a front portion, said upper portions and said lower portions of said side panels each including an engaging member provided therein, a door frame including an upper portion and a lower portion each having at least one cavity formed therein, and including two side portions, said upper portion and said lower portion of said door frame each including an engaging member provided therein, a door panel pivotally secured to said door frame, an upper panel and a lower panel each including a peripheral portion having a plurality of projections extended therefrom and engaged into said cavities of said side panels and said rear panel and said door frame for securing said upper panel and said lower panel to said side panels and said rear panel and said door frame, and a top panel and a base panel each including a peripheral portion having a plurality of engaging members provided therein and engaged with said engaging members of said side panels and said rear panel and said door frame for solidly securing said top panel and said base panel to said side panels and said rear panel and said door frame, wherein said base panel includes at least one hole formed therein, said lower panel includes at least one orifice formed therein, said tool box further includes at least one fastener engaged through said at least one orifice of said lower panel and engaged into said at least one hole of said base panel for further solidly securing said base panel and said lower panel together.

2. The tool box according to claim 1, wherein said side portions of said door frame each includes a groove formed therein, said front portions of said side panels each includes a flange extended therefrom and engaged into said grooves of said door frame for further solidly securing said side panels and said door frame together.

3. The tool box according to claim 1, wherein said engaging members of said side panels and said rear panel and said door frame each includes a beam, said engaging members of said top panel and said base panel each includes a rib engaged with said beam of said side panels and said rear panel and said door frame for solidly securing said top panel and said base panel to said side panels and said rear panel and said door frame.

4. The tool box according to claim 3, wherein said top panel and said base panel each includes a peripheral portion having a peripheral wall extended therefrom, said ribs are extended from said peripheral walls of said top panel and said base panel.

5. The tool box according to claim 1, wherein said side panels and said rear panel and said door frame each includes at least one rib extended inward of each of said cavities thereof, said projections of said upper panel and said lower panel each includes a plurality of ribs extended therefrom and engaged with said ribs of said side panels and said rear panel and said door frame for further solidly securing said upper panel and said lower panel to said side panels and said rear panel and said door frame.

6. The tool box according to claim 1, wherein said side panels and said rear panel each includes at least one channel formed therein, said tool box further includes at least one plate having a peripheral portion engaged in said channels of said side panels and said rear panel for securing said at least one plate to said side panels and said rear panel.

7. The tool box according to claim 6, wherein said side panels and said rear panel each includes at least one rib extended inward of each of said channels thereof, said at least one plate includes a peripheral portion having a plurality of ribs extended therefrom and engaged with said ribs of said side panels and said rear panel for further solidly securing said plate to said side panels and said rear panel.

8. The tool box according to claim 6, wherein said at least one plate includes a bottom portion having at least one depression formed therein for reducing a weight of said at least one plate.

9. The tool box according to claim 1, wherein said base panel includes a bottom portion having a plurality of wheels secured thereto for allowing said tool box to be easily moved.

* * * * *